US005918753A

United States Patent [19]

Ogg et al.

[11] Patent Number: 5,918,753

[45] Date of Patent: Jul. 6, 1999

[54] CONTAINER FOR AUTOMOTIVE FLUIDS

[75] Inventors: Richard Ogg, Littlestown; Michael C. Stephan, Lititz, both of Pa.

[73] Assignee: Graham Packaging Corporation, York, Pa.

[21] Appl. No.: 08/699,679

[22] Filed: Aug. 14, 1996

[51] Int. Cl.[6] ..... B65D 1/02; B65D 1/42

[52] U.S. Cl. ..... 215/382; 215/10; 215/42; 220/669; 220/675

[58] Field of Search ..... 215/10, 40, 41, 215/382, 384; 220/666, 669, 675

[56] References Cited

U.S. PATENT DOCUMENTS

| | | | |
|---|---|---|---|
| D. 195,896 | 8/1963 | Garvey | 215/40 X |
| D. 282,050 | 1/1986 | Beaver et al. | D9/332 |
| D. 289,376 | 4/1987 | Nemits | D9/375 |
| D. 292,968 | 12/1987 | Darr | D9/370 |
| D. 296,667 | 7/1988 | Salter | D9/375 |
| D. 303,628 | 9/1989 | Beaver | D9/375 |
| D. 307,553 | 5/1990 | Matthews et al. | D9/403 |
| D. 309,100 | 7/1990 | Beaver | D9/375 |
| D. 337,946 | 8/1993 | Bridger et al. | D9/523 |
| D. 340,645 | 10/1993 | Bridger et al. | D9/528 |
| D. 344,235 | 2/1994 | Bridger et al. | D9/528 |
| D. 354,916 | 1/1995 | Park | D9/523 |
| 3,326,425 | 6/1967 | Smith | 215/382 X |
| 4,293,084 | 10/1981 | Lussier | 215/365 X |
| 4,832,211 | 5/1989 | Matthews et al. | 215/365 X |
| 4,838,464 | 6/1989 | Briggs | 222/478 |
| 4,877,142 | 10/1989 | Doering | 215/10 X |
| 4,949,857 | 8/1990 | Russell | 215/40 X |
| 4,949,861 | 8/1990 | Cochran | 215/382 X |
| 4,957,209 | 9/1990 | Helin | 215/10 X |
| 5,261,544 | 11/1993 | Weaver, Jr. | 220/666 X |

OTHER PUBLICATIONS

Article on View–Stripe Bottle "Packaging" Dec. 1986, vol. 31, No. 13, p. 15.

*Primary Examiner*—Sue A. Weaver
*Attorney, Agent, or Firm*—Howson and Howson

[57] ABSTRACT

A lightweight blow-molded plastic container providing enhanced top loading capability. The container is rectangular in elevation and plan, and has four vertically extending post corners at the juncture of front, back and side walls. The front and back walls have label mounting areas defined by upper and lower label bumpers. The bumpers extend horizontally and terminate a spaced distance from the side walls, thus allowing the vertical corners of the container to extend uninterrupted and provide maximum post strength to the container. The configuration is capable of being made from a reduced amount of plastic, yet provides enhanced top loading capability as compared with like-sized known container configurations.

2 Claims, 3 Drawing Sheets

CONTAINER FOR AUTOMOTIVE FLUIDS

FIELD OF THE INVENTION

The present invention relates to a blow-molded plastic container specifically designed to package automotive fluids, and more particularly, the present invention relates to a container configuration which is made from a minimum of plastic material yet provides improved stability and top loading capabilities.

BACKGROUND OF THE INVENTION

In excess of two billion one liter packages of motor oil are sold annually in the United States alone. Therefore, improvements to the packaging of motor oil and other automotive fluids can be of significant concern to the automotive industry, the packaging industry and consumers.

Blow-molded plastic containers for automotive fluids are available in a variety of shapes and are normally made from high density polyethylene in an extrusion blow-molding process. Some of these containers are designed to have substantially rectangular footprints so that they may be stacked and shipped on standard sized shipping pallets.

An example of a one liter container for automotive fluids is disclosed in U.S. Pat. No. 4,877,142 issued on Oct. 31, 1989 to Doering and assigned to Texaco. The Texaco container has a substantially rectangular footprint for efficient packing and shipping, and has an offset spout which facilitates pouring. Surveys have indicated that this style of container is received favorably by consumers.

A significant portion of the cost to manufacture blow molded containers is in the plastic required to make the containers. For instance, the referenced Texaco container requires about 51 grams of HDPE.

Significant savings can be achieved by reducing the amount of plastic required to make each container. As an example, assume that HDPE is sold at approximately 40 cents/pound (0.00088 cents/gram), that a reduction of three grams of plastic per container can be achieved, and that 100 million containers are to be produced for a given year. The reduction of as little as three grams of HDPE per container would result in a savings of $300,000.00.

The degree of container rigidity required for packing and shipping purposes prevents manufacturers from reducing the amount of plastic in the manufacture of containers. Filled containers are packed in bulk in cardboard boxes, or plastic wrap, or both, and placed on shipping pallets. A bottom row of packed, filled containers may support several upper tiers of filled containers, and potentially, several upper boxes of filled containers. The lowermost containers in the stock must be sufficiently rigid to resist distortion under these packing and shipping conditions.

The rigidity of containers is measured by compression tests and is referred to as top loading capability. For instance, the referenced one liter Texaco container manufactured from 51 grams of HDPE has a top loading capability of about 45 to 50 pounds. A reduction of plastic in the container would be expected to result in a decrease in top loading capability. Thus, for every container configuration, a balance must be achieved between minimizing the amount of plastic for cost saving purposes while providing a sufficient amount of plastic to provide container rigidity.

Although the referenced Texaco container functions satisfactorily for its intended purposes, there is a need for a blow-molded plastic container which is similar in configuration, but which is capable of being manufactured from less plastic while having increased rigidity. A one liter version of the container should be capable of being manufactured from less than about 48 grams of HDPE to provide a cost savings of three grams per container, and it should provide a minimum of 50 pounds top loading capability.

OBJECTS OF THE INVENTION

With the foregoing in mind, a primary object of the present invention is to provide a novel blow-molded plastic container which is particularly suitable for containing automotive fluids.

Another object of the present invention is to provide an automotive fluid container which provides a sufficient amount of top loading capability while affording a reduction in the amount of plastic required to manufacture the container as compared with known like-sized automotive fluid plastic containers.

A further object is to provide an automotive fluid container having a configuration which is strong, relatively lightweight, and aesthetically appealing.

SUMMARY OF THE INVENTION

More specifically, the present invention provides an automotive fluid container having a front wall which is substantially parallel with a rear wall and which is connected to the rear wall by a right side wall, a left side wall and a base. The walls provide the container with a substantially rectangular plan and elevational configuration.

A shoulder supports a finish and connects the front, rear, right side and left side walls remote from the base. The finish is centrally oriented with respect to the front and rear walls and is positioned closer to one of the side walls. The location of the finish affords ease of pouring from the container.

An upper label bumper and a lower label bumper are formed on each of the front and rear walls to define label mounting areas. Each of the upper and lower label bumpers extends substantially horizontally and has opposite ends terminating a spaced distance from the side walls. Thus, the upper and lower label bumpers do not interrupt the junctures of the front and rear walls with the side walls.

Each juncture of the front and rear walls with the side walls is provided by a transitional wall having a curved shape in transverse cross-section. Each transitional wall forms a continuous post structure extending vertically from the base to the shoulder. The uninterrupted post structures provide the container with a sufficient degree of rigidity such that a minimum of plastic can be used to manufacture the container while still providing acceptable top loading capabilities.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 1:
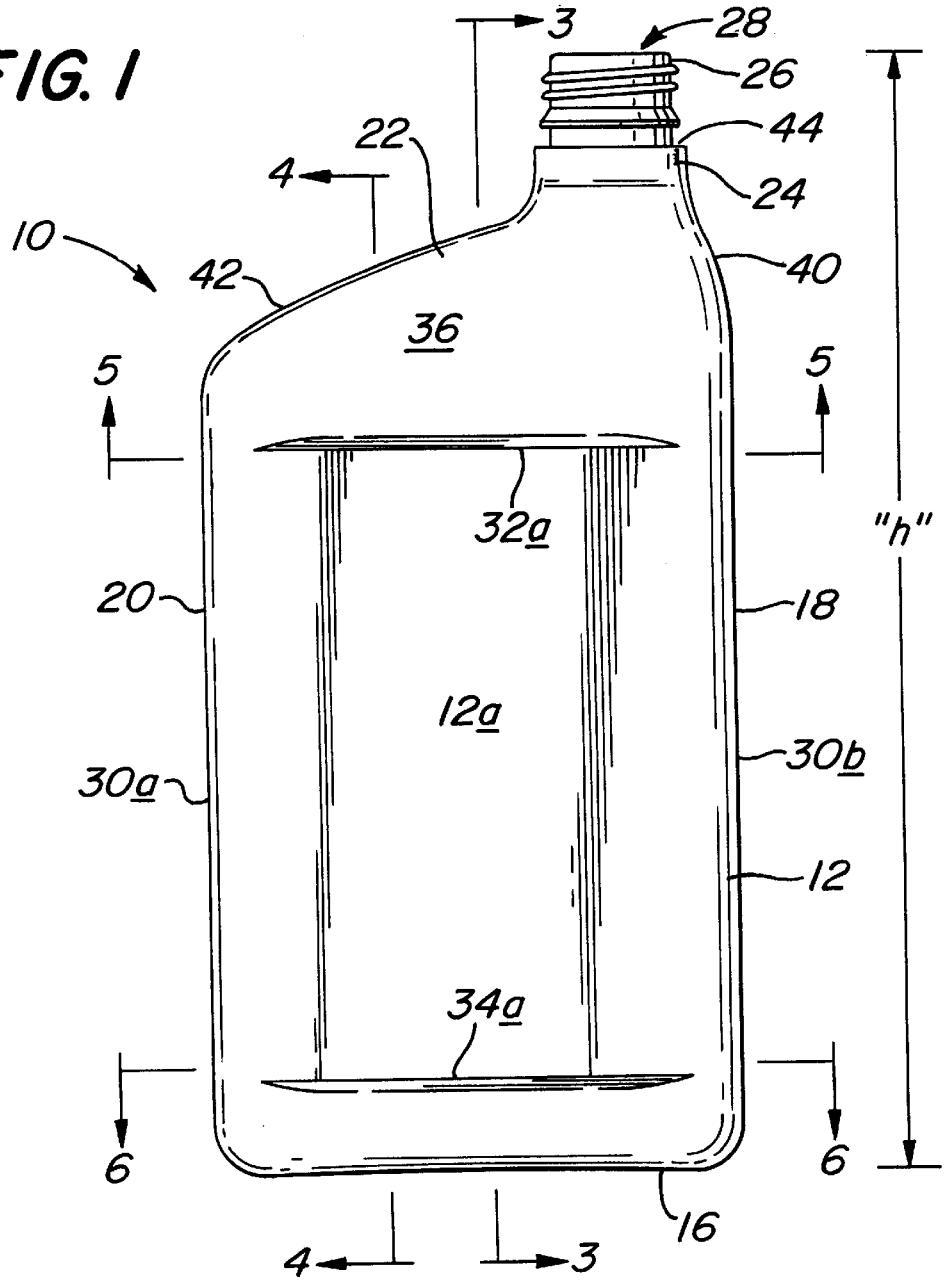
FIG. 1 is a front elevational view of a container embodying the present invention.
Figure 2:
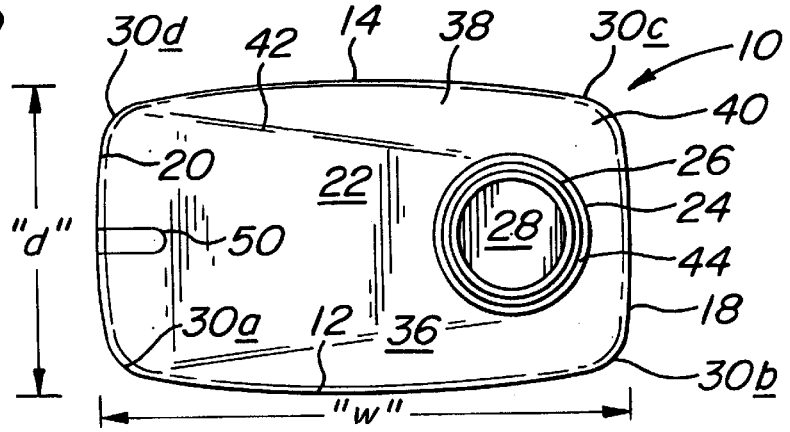
FIG. 2 is a top plan view of the container illustrated in FIG. 1.
Figure 3:
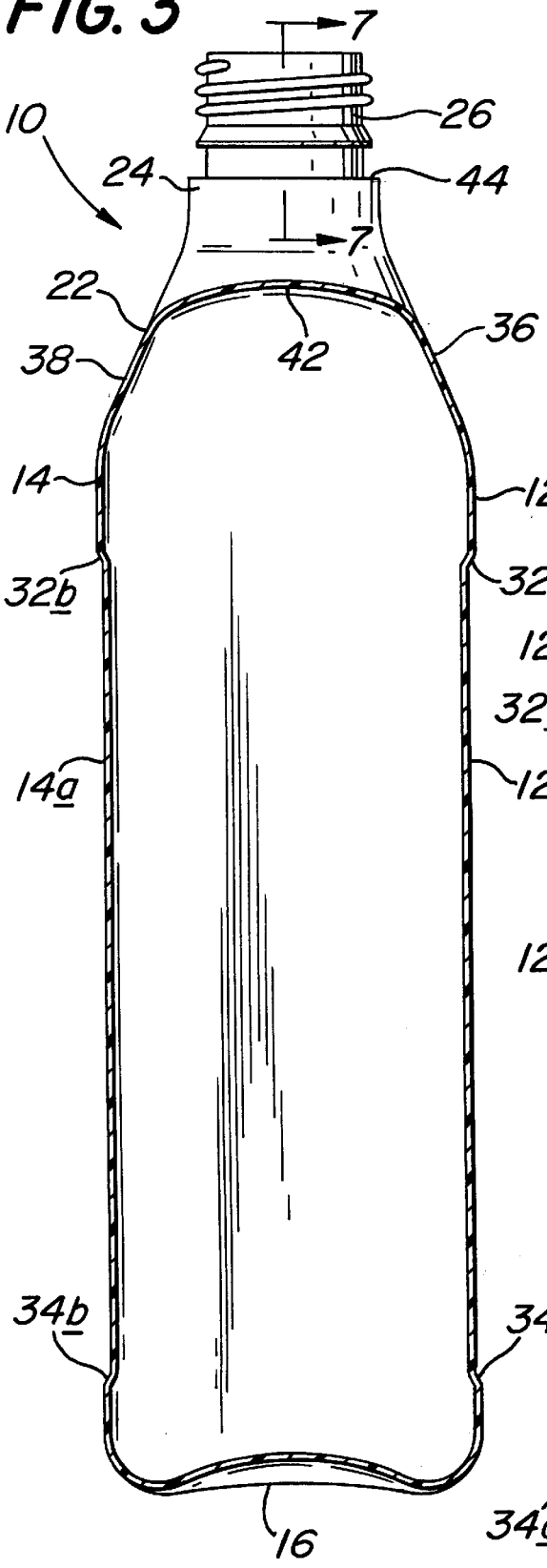
FIG. 3 is a cross-sectional view of the container taken along line 3—3 of FIG. 1.

FIG. 1 illustrates a blow-molded plastic container 10 for automotive fluids such as motor oil. The container 10 is designed to provide many of the aesthetic and functional qualities of the container disclosed in U.S. Pat. No. 4,877,142, the disclosure of which is incorporated herein by reference. However, the container 10 also incorporates many novel structural features which provide improved strength and rigidity. Thus, for like-sized containers, the container 10 is made from a reduced amount of plastic, yet has a greater top loading capability.

The container 10 has a substantially rectangular elevational and plan configuration. To this end, the container 10 has a front wall 12 substantially parallel with a back wall 14. The front wall 12 has a label mounting area 12*a,* and the back wall 14 has a label mounting area 14*a.* The front and back walls, 12 and 14, are connected together by a base 16, a right side wall 18 and a left side wall 20. The front and back walls, 12 and 14, base 16, and side walls, 18 and 20, provide the container 10 with a shorter depth "d" than width "w", and a shorter width "w" than height "h". The footprint provided by the container 10 is the same as that of the referenced Texaco container, and therefore, is readily packed and shipped.

The container 10 affords easy pouring. To this end, a shoulder 22 is connected to the front, back, right side and left side walls, 12, 14, 18 and 20, respectively, remote from the base 16. The shoulder 22 extends upwardly to a neck 24 which supports a threaded finish 26. The finish 26 defines an opening 28 through which the container 10 is filled with automotive fluid and through which the automotive fluid is subsequently dispensed. The finish 26 and opening 28 are centrally oriented between the front and back walls, 12 and 14, and are positioned closer to the right side wall 18 than the left side wall 20. Alternatively, they could be located closer to the left side wall 20. The finish 26 engages a threaded cap (not shown) to seal the container. In addition, the left side wall 20 has a view stripe 50 and indicia (not shown) to allow the consumer to pour a measured amount of fluid, or to determine the amount of fluid remaining in the container 10. Thus, the container 10 provides consumers with many of the features which they favor in the referenced Texaco container.

The novel structures of the container 10 provide it with improved top loading capability. For instance, although a one liter container according to the present invention is made from a reduced quantity of HDPE and provides a slightly greater liquid capacity than the referenced Texaco container, it also provides a significantly increased top loading capability. The increased strength of the container 10 is attributed to three aspects: the continuous post-like vertical corners, the crown-shaped shoulder, and the expanded diameter of the neck, all of which will be discussed in detail.

Figure 5:
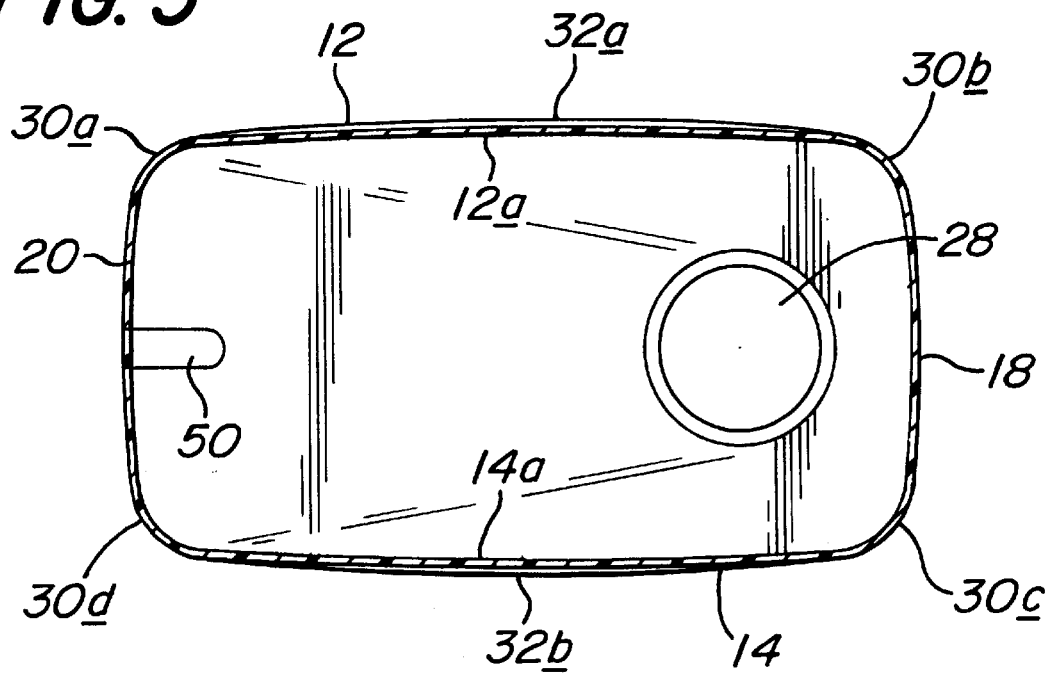
FIG. 5 is a cross-sectional view of the container taken along line 5—5 of FIG. 1.
Figure 6:
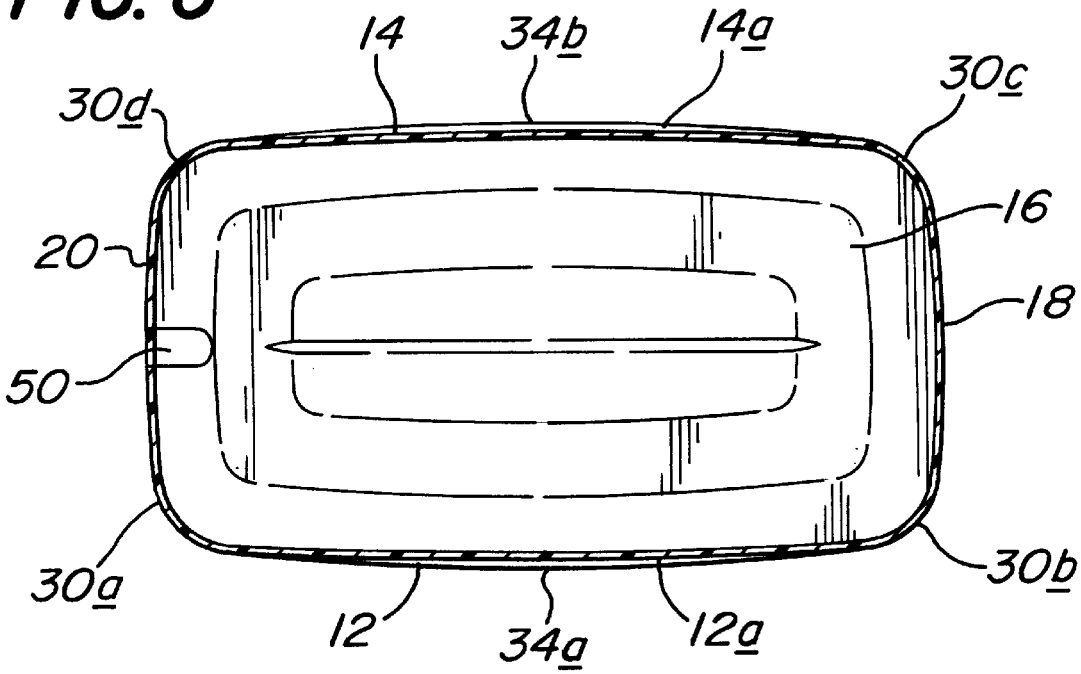
FIG. 6 is a cross-sectional view of the container taken along line 6—6 of FIG. 1.

Four transitional walls 30*a,* 30*b,* 30*c,* and 30*d* are formed at the junctures of the front and back walls, 12 and 14, with the side walls, 18 and 20. Each of the transitional walls 30*a–d* extends continuously from the base 16 to the shoulder 22 and has a curved shape in transverse cross-section as illustrated in FIGS. 5 and 6. The transitional walls 30*a–d* provide the container 10 with post strength to support the container 10 when top loaded.

The specific configuration of the front and back walls 12 and 14 allow the transitional walls 30*a–d* to extend uninterrupted. To this end, the label mounting area 12*a* is defined by an upper label bumper 32*a* and a lower label bumper 34*a,* and the label mounting area 12*b* is defined by an upper label bumper 32*b* and a lower label bumper 34*b.* As illustrated in FIGS. 3–6, each label mounting area, 12*a* and 12*b,* is smooth and uninterrupted, and extends slightly inward between the bumpers 32*a,* 32*b* and 34*a,* 34*b.* The bumpers, 32*a* and 34*a,* as illustrated in FIG. 1, extend substantially horizontally across the front and back walls, 12 and 14, but terminate a spaced distance from the transitional walls 30 and the side walls 18 and 20. This configuration allows ready mounting of labels on the front and back walls, 12 and 14, while allowing the transitional walls 30*a–d* to remain uninterrupted for adding post strength to the container 10.

Another structure which strengthens the container 10 is the configuration of the shoulder 22. The shoulder 22 is formed by: a front section 36 extending from the front wall 12 to the neck 24, a back section 38 extending from the back wall 14 to the neck 24, a right side section 40 extending from the right side wall 18 to the neck 28, and a top section 42 extending from the left side wall 20 to the neck 24.

The unique aspect of the shoulder 22 is the connection between the top section 42 and the front and back shoulder sections, 36 and 38. The top section 42 is concave inwardly adjacent the neck 42 to provide a continuously, inwardly curved, crown which extends from a location adjacent the finish 26 to a location adjacent the sidewall opposite the finish 26. Thus, its connections with the front and back shoulder sections, 36 and 38, are not formed by sharp corners; rather, the transition from the top section 42 is formed by gentle curves. A load placed on the container 10 will be evenly supported by the entire shoulder, thereby resisting unwanted deformations.

Figure 7:
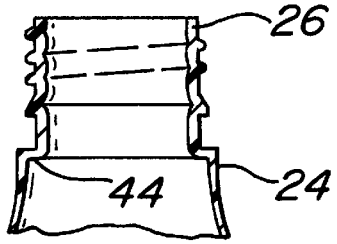
FIG. 7 is a cross-sectional view of the container taken along line 7—7 of FIG. 3.
Figure 4:
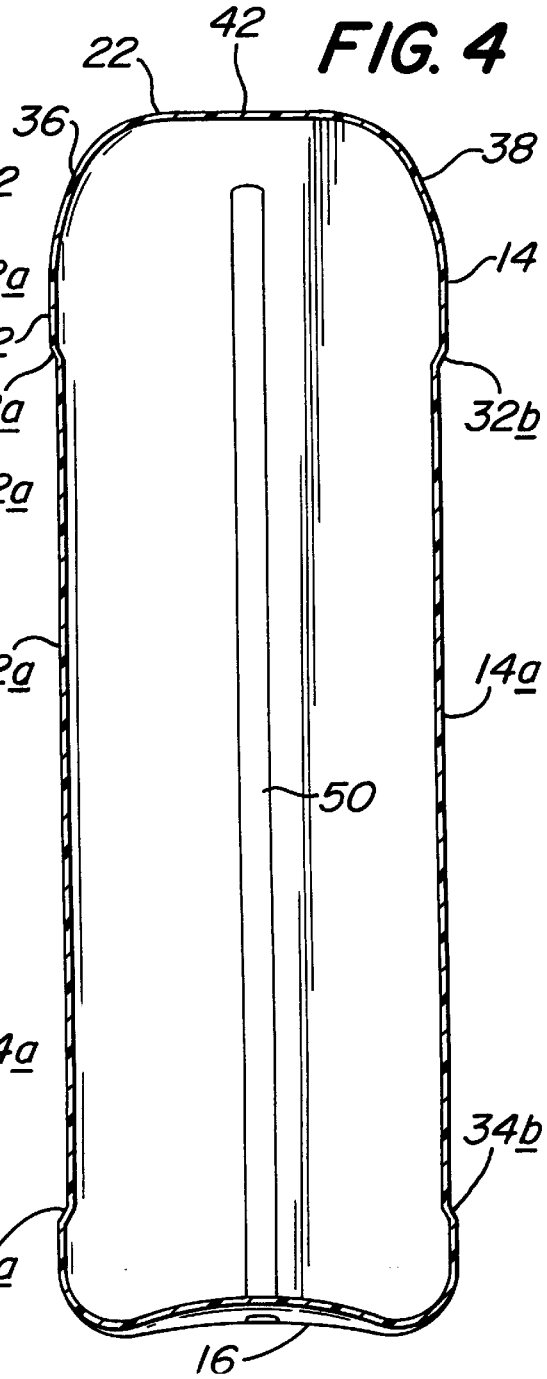
FIG. 4 is a cross-sectional view of the container taken along line 4—4 of FIG. 1.

The final structure which functions to strengthen the container 10 is the expanded size of the neck 24. As best shown in FIG. 7, the finish 26 connects to the neck 24 by a peripheral outwardly extending flange 44 located at the bottom of the finish 26. The lateral extent of the flange 44 has been increased to allow the flange to flex inwardly under certain loading conditions instead of allowing the finish 26 and neck 24 to collapse.

By way of example, and not by way of limitation, a preferred container 10 can have about a 35.4 fluid ounce capacity and be made of about 48 grams of HDPE. The height "h" from base to finish is about 8.8 inches, and the footprint is provided by about a 4.3 inch width "w" and about a 2.4 inch depth "d". The finish is centrally oriented with respect to the front and back walls, and it is located about 1.2 inches from the midpoint between the side walls toward the right side wall. The upper and lower bumpers extend horizontally about 3.4 inches and terminate about 0.45 inches from the side walls. The upper and lower label bumpers are spaced apart vertically about 5.0 inches. The neck of the container below the finish has a diameter greater than about 1.2 inches. The described structure provides the container with a top loading capability of about 65 pounds. Thus, despite the elimination of three grams of plastic, the novel container structure provides enhanced rigidity.

While a preferred container has been described in detail, various modifications, alterations, and changes may be made without departing from the spirit and scope of the present invention as defined in the appended claims.

We claim:

1. In a container for packaging automotive fluids, said container having a rectangular front wall substantially parallel with a rectangular rear wall, said front wall being connected to said rear wall by an elongate right side wall and an elongate left side wall providing said container with a substantially rectangular plan and elevational configuration, said front, rear, right side and left side walls being connected by a base at one end of said container and a shoulder at a remote end of said container, a finish extending from said shoulder, said finish being centrally oriented with respect to said front and rear walls and being positioned closer to one of said side walls, the improvement comprising:

an upper label bumper spaced from said shoulder and a lower label bumper spaced from said base formed on each of said front and rear walls to define label mounting areas on said front and rear walls, said label mounting areas being substantially planar, each of said upper and lower label bumpers extending substantially horizontally and having opposite ends, each of said opposite ends terminating a spaced distance from said side walls such that each juncture of said front and rear walls with said side walls are uninterrupted by said upper and lower label bumpers, each of said junctures of said front and rear walls with said side walls being a corner having a curved shape in transverse cross-section and forming a continuous post structure extending vertically from said base to said shoulder without interruptions; and said shoulder being formed by a front section connecting between said finish and said front wall, a rear section connecting between said finish and said rear wall, a right side section connecting between said finish and said right side wall, and a left side section connecting between said finish and said left side wall, one of said side sections of said shoulder extending a further distance across said container to said finish and forming a top section of said shoulder, said top section being inwardly concave and connecting to said front and rear sections of said shoulder by gentle curves providing said shoulder with a continuous inwardly curved crown without sharp corners so that a load placed on the container is evenly supported by said entire shoulder thereby resisting unwanted deformation.

2. A container according to claim 1, wherein said container is manufactured from less than about 48 grams of HDPE and has a minimum of top loading capability of about 50 pounds.

* * * * *